US006845355B2

(12) United States Patent
Sasaki et al.

(10) Patent No.: US 6,845,355 B2
(45) Date of Patent: Jan. 18, 2005

(54) VOICE DATA RECORDING AND REPRODUCING DEVICE EMPLOYING DIFFERENTIAL VECTOR QUANTIZATION WITH SIMPLIFIED PREDICTION

(75) Inventors: Hiroshi Sasaki, Tokyo (JP); Masayasu Sato, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 585 days.

(21) Appl. No.: 09/776,903

(22) Filed: Feb. 6, 2001

(65) Prior Publication Data

US 2001/0044715 A1 Nov. 22, 2001

(30) Foreign Application Priority Data

May 18, 2000 (JP) ..... 2000/146396

(51) Int. Cl.[7] ..... G10L 19/00
(52) U.S. Cl. ..... 704/219; 704/220
(58) Field of Search ..... 704/219, 220, 704/222

(56) References Cited

U.S. PATENT DOCUMENTS 5,228,086 A 7/1993 Morii
5,359,696 A * 10/1994 Gerson et al. ..... 704/223
5,774,838 A * 6/1998 Miseki et al. ..... 704/222
5,802,487 A * 9/1998 Tanaka ..... 704/230
6,088,667 A * 7/2000 Murashima ..... 704/219
6,212,495 B1 * 4/2001 Chihara ..... 704/221

FOREIGN PATENT DOCUMENTS

JP 4-125700 4/1992

OTHER PUBLICATIONS

"An Algorithm for Vector Quantizer Design" by Linde et al., IEEE Transactions on Communications, vol. Com 28, No. 1, Jan. 1980, pp. 84–95.

* cited by examiner

*Primary Examiner*—Daniel Abebe
(74) *Attorney, Agent, or Firm*—Rabin & Berdo, P.C.

(57) ABSTRACT

A voice recording and reproducing device employing differential vector quantization divides an input voice signal into frames and predicts the sample values of each frame. The first sample value in a frame is predicted from one or more sample values of the preceding frame. Each predicted sample value is then used in predicting the next sample value in the same frame. For example, the predicted sample values may be fed back into a shift register that is initially loaded with sample values from the preceding frame, and prediction may be carried out by an arithmetic operation on the shift-register contents. This scheme reduces the amount of arithmetic circuitry needed for making the predictions, and reduces the cost of the device.

12 Claims, 9 Drawing Sheets

VOICE DATA RECORDING AND REPRODUCING DEVICE EMPLOYING DIFFERENTIAL VECTOR QUANTIZATION WITH SIMPLIFIED PREDICTION

BACKGROUND OF THE INVENTION

This invention relates to voice recording by differential vector quantization.

The market for voice recording and reproducing devices, often referred to as voice recorders, is now in a state of active growth. The reason is that a combination of increasing record/playback time and decreasing cost is opening up new applications in business tools and consumer electronic devices. In particular, digital voice recorders employing integrated-circuit (IC) memory as storage media are now finding many applications.

For business applications, a long recording time and good sound quality are essential requirements. The factor enabling these requirements to be met has been the recent rapid progress in high-efficiency compression technology. Compression is achieved through coding techniques that make intensive use of complex, sophisticated digital signal processing, which requires a fast, high-performance digital signal processor (DSP). For that reason, business-grade voice recorders based on IC memory still tend to be fairly expensive.

For consumer products such as radio sets, long recording time and good sound quality are secondary considerations; the essential requirement is low cost. Applications in consumer products must dispense with complex, sophisticated signal processing and employ coding techniques that can be implemented comparatively simply.

Vector quantization (VQ) is one such technique. Briefly, in vector quantization, a voice waveform is divided into short frames, each of which is approximated by a pattern taken from a codebook, and index numbers identifying the patterns are recorded in place of the actual waveform data. Differential vector quantization is a similar technique that predicts the voice waveform in each frame and uses the patterns in the codebook to approximate the difference between the predicted and actual waveforms.

While vector quantization has the advantage of simplicity, it may require a large codebook to achieve satisfactory sound quality. Differential vector quantization can provide equivalent sound quality with a smaller codebook, but requires an extra prediction step. In conventional differential vector quantization, the cost of the prediction process is fairly high, because it involves multiplication of a full frame of waveform data by a matrix of prediction coefficients. The cost is a computational cost if the prediction is done by software, or a physical circuit cost if the prediction is done by hardware. In either case, there is an associated economic penalty: more circuitry is required, or a faster processor is required.

Further details will be given in the detailed description of the invention.

SUMMARY OF THE INVENTION

An object of the present invention is to simplify the prediction process used in differential vector quantization of voice signals.

In the invented method of coding a voice signal, the voice signal is sampled and divided into frames, each including a predetermined number of sample values. The sample values are predicted, and the differences between the predicted and actual sample values of each frame are coded by vector quantization with reference to a codebook. The coded data are stored in a memory device, and can be decoded with reference to the codebook.

In the prediction process, the first sample value of a given frame is predicted from one or more sample values of the immediately preceding frame. Then each predicted sample value in the given frame is used in predicting the next sample value in the same frame.

For example, sample values of the immediately preceding frame may be loaded into a shift register, and each predicted value may be fed back into the shift register. In this case, each predicted sample value is obtained by a multiply-add operation performed on the sample values currently stored in the shift register.

More simply, the first predicted sample value in the frame may be set equal to the last sample value of the immediately preceding frame, and each other predicted sample value in the frame may be set equal to the preceding predicted sample value, so that all predicted sample values in the frame are equal to the last sample value of the immediately preceding frame.

The invention also provides voice signal recording and reproducing devices employing the invented method.

DETAILED DESCRIPTION OF THE INVENTION

Embodiments of the invention will be described below, following a more detailed description of vector quantization and differential vector quantization.

Figure 1:
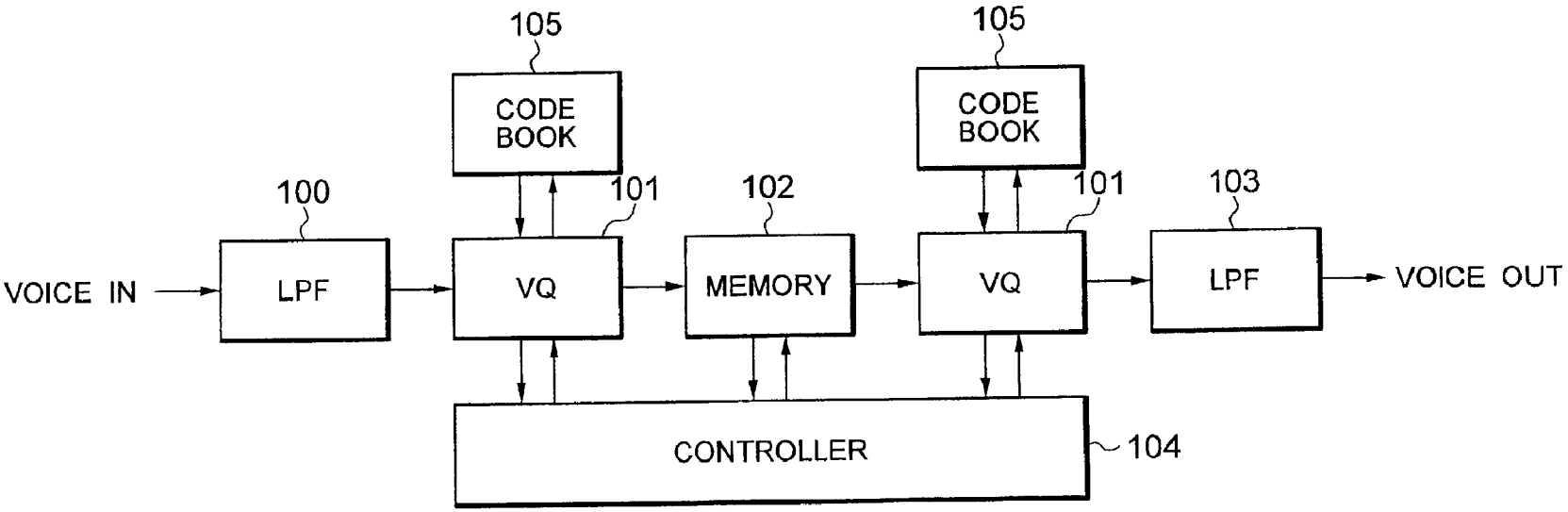
FIG. 1 PRIOR ART
FIG. 1 is a block diagram of a conventional voice recorder employing vector quantization.

For general reference, FIG. 1 shows a conventional voice recorder employing vector quantization. The component elements include an input low-pass filter (LPF) 100, a vector quantizer (VQ) 101 (shown twice), a memory device 102, an output low-pass filter 103, a controller 104, and a codebook 105 (shown twice). In the recording mode, an input voice signal is filtered by low-pass filter 100 to prevent aliasing, then sampled at a predetermined frequency by the vector quantizer 101, coded with reference to the codebook 105, and written into the memory device 102. In the playback mode, the coded data are read from the memory device 102 by the vector quantizer 101, decoded with reference to the codebook 105, and output to low-pass filter 103, which generates an output voice signal. Operations in both modes are controlled by the controller 104.

Figures 2A, 2B:
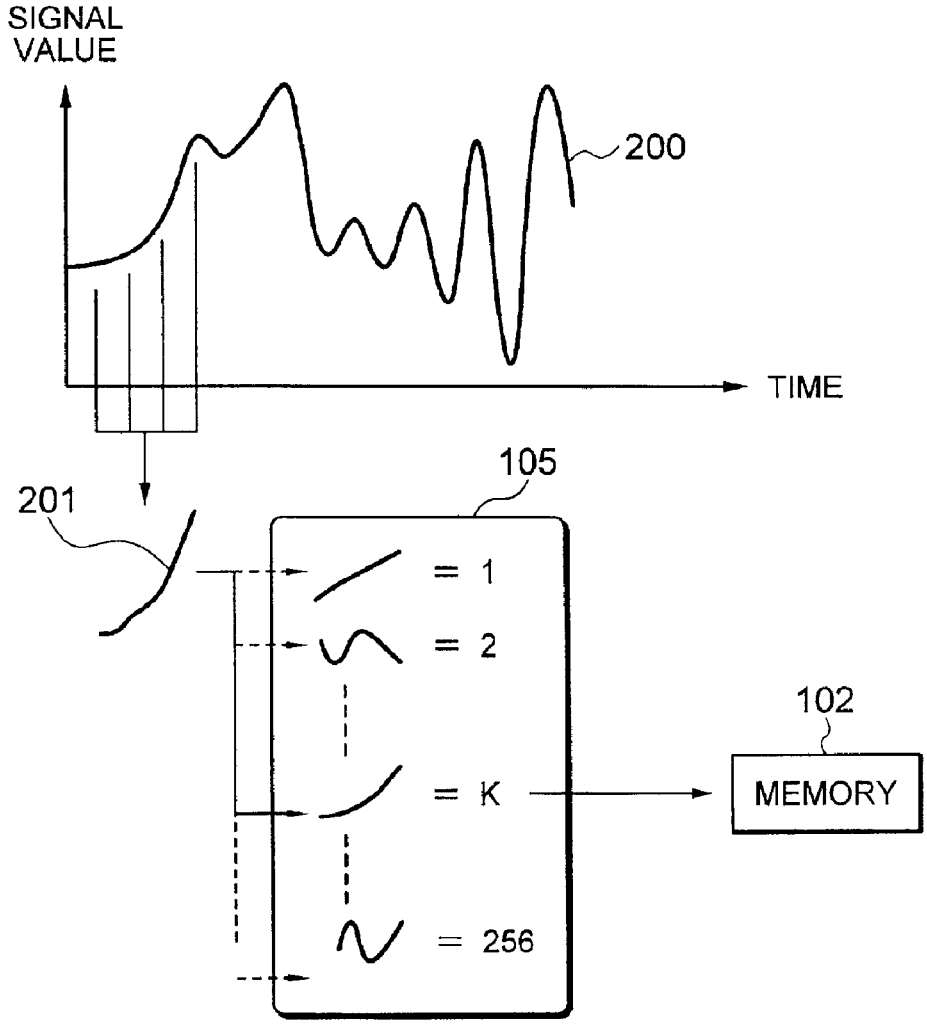
FIG. 2A PRIOR ART
FIG. 2B PRIOR ART
FIG. 2A illustrates a frame in voice signal waveform.
FIG. 2B illustrates the coding of the frame in FIG. 2A.

FIG. 2A illustrates the sampling of a low-pass-filtered voice signal 200 by the vector quantizer 101. The vector quantizer 101 groups the samples into frames with a fixed length L. Throughout the following description, four consecutive samples will constitute one frame (L=4). The four sample values are referred to collectively as a vector.

FIG. 2B schematically illustrates the contents of the codebook 105 and the coding operation. The codebook 105 stores a number of fixed waveform patterns having the length of one frame. Although shown as a continuous waveform, each pattern is actually stored as a vector comprising four sample values. Each pattern is identified by an index number. Given a frame 201 of the sampled voice signal, the vector quantizer 101 finds the stored pattern that most closely matches the waveform of the frame, and writes its index number in the memory device 102 as the coded value of the frame. In the example shown, a pattern with a certain index number K most closely matches the frame waveform 201, so K is written in the memory device 102. The Euclidean distance metric, for example, can be used to identify the most closely matching pattern.

In FIG. 2B, as there are two hundred fifty-six patterns in the codebook 105, the index number has an eight-bit value. If each sample also has an eight-bit value, the coding process compresses the signal data by a factor of four.

Conceptually, the frame waveforms or vectors occupy a multidimensional space that is partitioned into cells of various sizes and shapes. The codebook 105 stores one vector per cell, located at the centroid of the cell; the stored vector is used as an approximation to all vectors in the cell. The codebook 105 can be constructed from an arbitrary set of actual voice waveform data, referred to as training data, by use of the well-known Linde-Buzo-Gray (LBG) algorithm. This algorithm is illustrated in the flowchart in FIG. 3 and is briefly described below. The arrows indicating vectors in FIG. 3 will be omitted in the following description.

(1) The training data ($x_i$, i=1 to Num) are obtained, and values are assigned to a scale factor S and control parameters Nend and Eend. Each $x_i$ is a vector representing one frame of training data, and Num is the number of vectors.

(2) The vector average of all the training data $x_i$ is calculated as an initial centroid $c_1$ (step 301).

(3) If the necessary number of centroids has not yet been generated ('No' in step 302), the present number of centroids is doubled by splitting the centroids. The scale factor S and a random vector r are used to modify each present centroid $c_k$ and generate a new centroid $c_{k+n}$ (step 303).

(4) The centroids obtained in step (3) are iteratively modified. In each iteration, vector quantization is performed on the training data by using the centroids in their existing positions, and the quantization distortion $E_i$ is computed (step 304). This distortion $E_i$ is compared with the distortion $E_{i-1}$ in the previous iteration (step 305), and if the proportional improvement is less than Eend, the process returns to step 302. Otherwise, the modified centroids are repositioned, e.g., by using the scale factor S and random vectors r again (step 306).

(5) This process continues until the necessary number of centroids have been generated ('Yes' in step 302).

Figure 3:
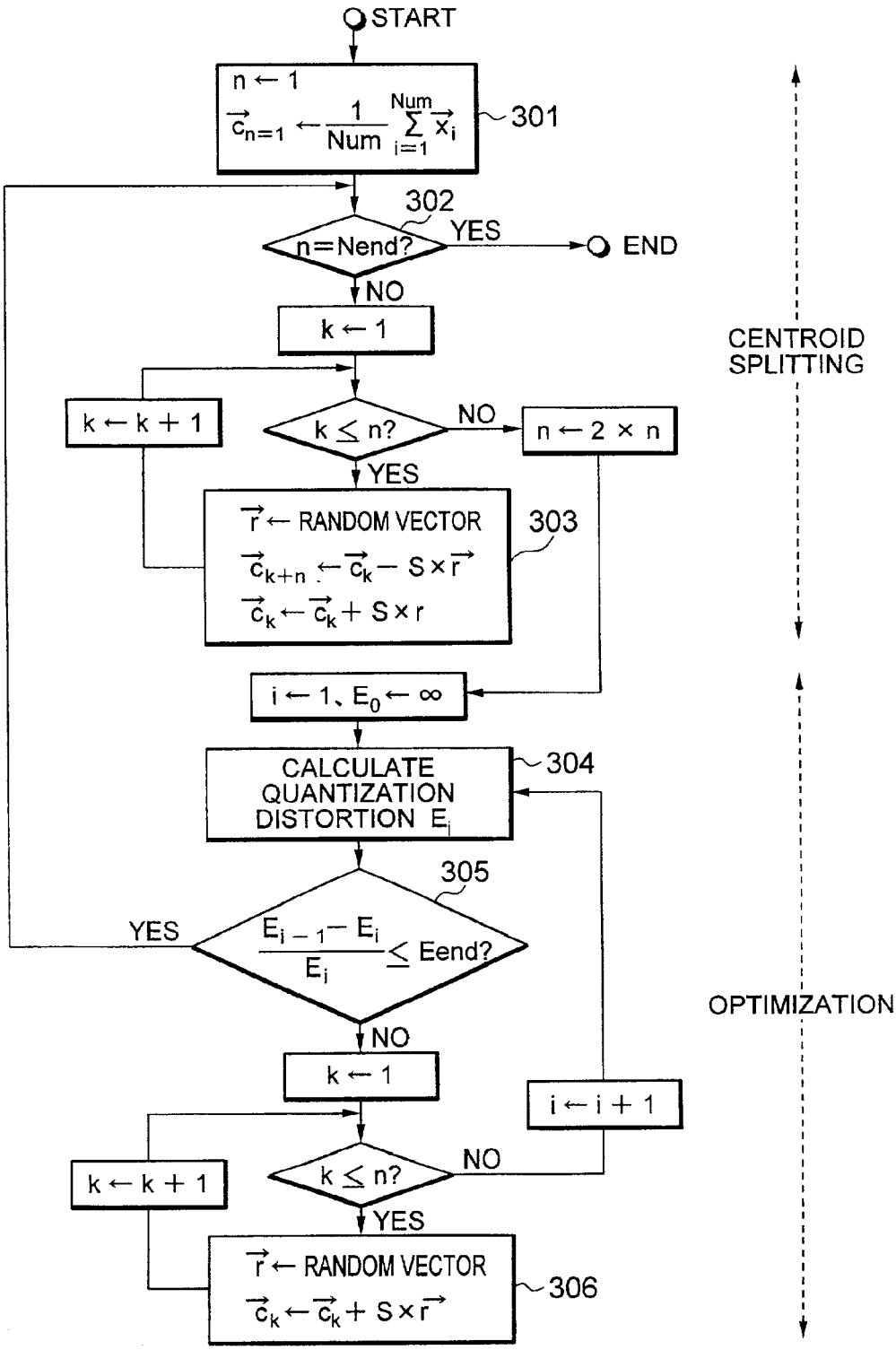
FIG. 3 PRIOR ART
FIG. 3 is a flowchart of an algorithm for constructing a codebook.

In step 306 in FIG. 3, instead of being randomly repositioned, each ck may be moved to the centroid of the set of training vectors that are closer to $c_k$ than to any other $c_j$ ($j \neq k$).

Both the LBG algorithm and the vector quantization process itself are easy to implement. Once the codebook 105 has been generated, in the recording process, it is only necessary to group the samples into frames and search the codebook for the pattern most closely matching each frame. Playback is an even simpler pattern look-up process. These features make vector quantization an attractive, low-cost means of extending the recording time of a voice recorder without requiring more memory for storing the recorded voice signals.

As noted above, however, vector quantization has the disadvantage that a large codebook may be necessary if good sound quality is to be achieved. In practice, a separate memory device such as a read-only-memory (ROM) IC may be needed merely to store the codebook, offsetting the advantage of reduced memory for storing the compressed signal data.

A voice recording device employing differential vector quantization will now be described with reference to FIG. 4. The illustrated device includes a low-pass filter 400 (shown twice), a frame buffer 401 (shown twice), a coding unit 402, a decoding unit 403, a codebook 404 (shown twice), and a memory device 405.

In the recording mode, the input voice signal is passed through the low-pass filter 400 to prevent aliasing, then sampled at a predetermined sampling frequency in the frame buffer 401. The filtered sample data are buffered in registers (not visible) in the frame buffer 401, then coded by the coding unit 402, using the codebook 404. The coded data, comprising the index numbers of waveform patterns in the codebook 404, are stored in the memory device 405. In the playback mode, the coded data are read sequentially from the memory device 405 and decoded by the decoding unit 403, using the codebook 404. The decoded data are buffered in the frame buffer 401, then output through the low-pass filter 400 at a predetermined rate. The low-pass filter 400 converts the decoded data to an output voice signal.

The coding unit 402 and decoding unit 403 both incorporate means for predicting the signal waveform of each frame from the preceding frame, but they differ in the way the prediction is used.

Figure 5:
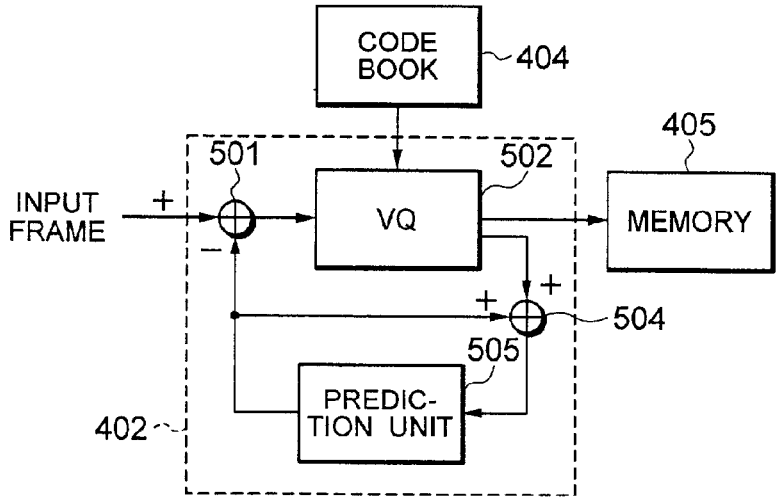
FIG. 5 PRIOR ART
FIG. 5 is a block diagram of the coding unit in FIG. 4.

Referring to FIG. 5, the coding unit 402 comprises a subtractor 501, a vector quantizer 502, an adder 504, and a prediction unit 505. An input frame waveform is supplied to the subtractor 501, which subtracts a predicted frame waveform supplied by the prediction unit 505 and sends the resulting differential frame waveform to the vector quantizer 502. The vector quantizer 502 finds the pattern stored in the codebook 404 that most closely matches the differential frame waveform, sends this pattern to the adder 504, and writes the index number of the pattern in the memory device 405. The adder 504 adds the supplied pattern to the predicted frame waveform to generate a decoded waveform. The prediction unit 505 predicts the waveform of the next frame from the decoded waveform output by the adder 504.

Figure 6:
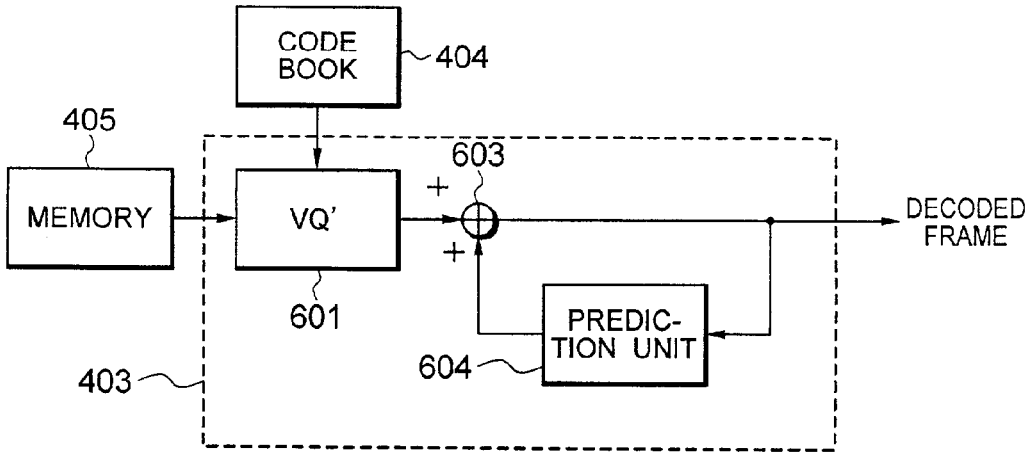
FIG. 6 PRIOR ART
FIG. 6 is a block diagram of the decoding unit in FIG. 4.

Referring to FIG. 6, the decoding unit 403 comprises a vector dequantizer (VQ') 601, an adder 603, and a prediction unit 604. The vector dequantizer 601 reads stored index numbers from the memory device 405 and obtains the corresponding frame patterns from the codebook 404. The adder 603 adds each frame pattern to a predicted waveform, supplied by the prediction unit 604, to obtain a decoded frame waveform, which is output to the frame buffer 401 (not visible) and the prediction unit 604. The prediction unit 604 predicts the waveform of the next frame from the decoded frame waveform.

Although the two prediction units 505, 604 are shown separately in the drawings, they operate in the same way, so a single prediction unit may be shared by both the coding unit 402 and decoding unit 403.

The codebook 405 employed in differential vector quantization is generated in a different way from the codebook employed in ordinary vector quantization. The LBG algorithm is used, but instead of being applied to voice data waveforms, it is applied to differences between the voice data waveforms and predicted waveforms, the prediction being carried out by the same process as in the waveform coding and decoding units. A flowchart will be omitted, but the procedure for generating the codebook can be outlined in the following series of steps.

(1) The training voice data are converted to differential data by steps (2) to (10).

(2) A control variable I is set to zero.

(3) The I-th frame of training data is obtained. The process jumps to step (7) if this frame is the last frame.

(4) The I-th frame is supplied to the prediction unit.

(5) The output of the prediction unit is stored as the (I+1)-th predicted frame.

(6) I is incremented by one and the process returns to step (3).

(7) I is set to one.

(8) The I-th frame of training data is obtained again.

(9) The difference between the I-th frame of training data and the I-th predicted frame is calculated and stored as the I-th differential frame.

(10) If the I-th frame is not the last frame, I is incremented by one and the process returns to step (8). Otherwise, the process proceeds to step (11).

(11) The LBG algorithm is applied to the differential frames.

As shown above, in a voice recorder employing differential vector quantization, prediction is an essential part of both the recording process and the playback process, as well as the process of generating the codebook. Prediction is conventionally carried out by the matrix operation given by equation (1) below.

$$(Y_{t+1,i})=(P_{k,1})\ (X_{t,i}) \tag{1}$$

Figure 7:
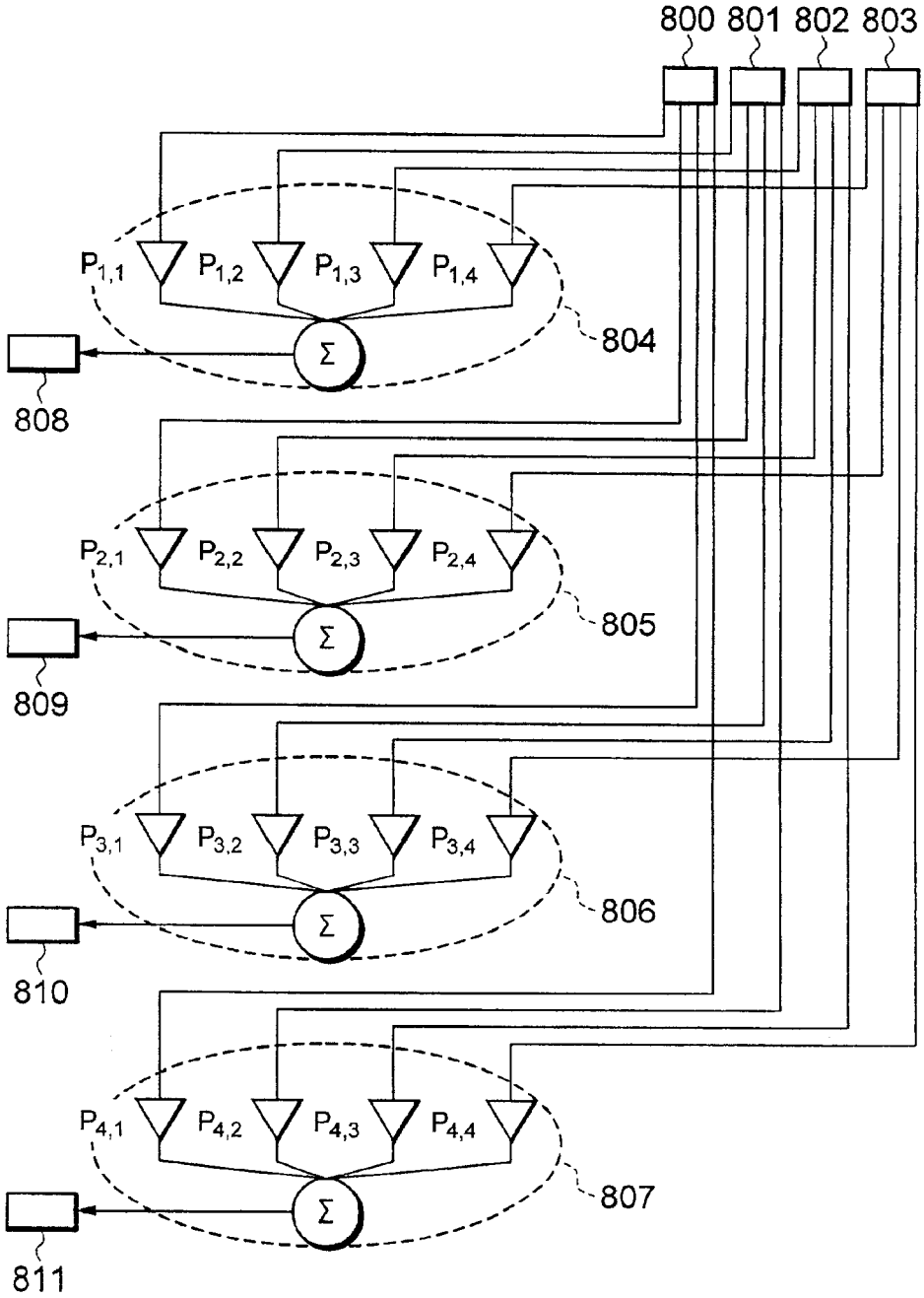
FIG. 7 PRIOR ART
FIG. 7 is a schematic diagram of a conventional prediction unit that can be used in FIGS. 5 and 6.

In equation (1), $(Y_{t+1,i})$ (i=1, 2, 3, 4) is a column vector representing the predicted waveform of the (t+1)-th frame, t being an arbitrary integer. $(P_{k,l})$, (k=1, 2, 3, 4; l=1, 2, 3, 4) is a four-by-four matrix of prediction coefficients. $(X_{t,i})$ (i=1, 2, 3, 4) is a column vector representing the waveform, or the decoded waveform, of the t-th frame, If the prediction is carried out by hardware, the prediction unit has, for example, the structure shown in FIG. 7, comprising four registers 800, 801, 802, 803 for storing an input waveform, four multiply-add units 804, 805, 806, 807, and four registers 808, 809, 810, 811 for storing the predicted waveform. The four-by-four prediction matrix $(P_{k,l})$ is built into the multiply-add units, which operate on the input frame waveform data $(X_{t,i})$, thereby obtaining the predicted waveform $(Y_{t+1,i})$ of the next frame.

The prediction operation is carried out as follows. First, the input waveform is buffered, $X_{t,1}$ being stored in register 800, $X_{t,2}$ in register 801, $X_{t,3}$ in register 802, and $X_{t,4}$ in register 803. Multiply-add unit 804 multiplies the input waveform values $X_{t,1}$ to $X_{t,4}$ by respective prediction coefficients $P_{1,1}$ to $P_{1,4}$,takes the sum of the four products, and stores the sum as $Y_{t+1,1}$ in register 808. Multiply-add unit 804 uses prediction coefficients $P_{2,1}$ to $P_{2,4}$ to calculate $Y_{t+1,2}$ in the same fashion, and stores the result in register 809. $Y_{t+1,3}$ and $Y_{t+1,4}$ are calculated similarly and stored in registers 810 and 811. The values $Y_{t+1,1}$ to $Y_{t+1,4}$ are output as the predicted waveform of the next frame.

The advantage of differential vector quantization is that the differential waveforms tend to have smaller values and less variation than the input voice waveforms. They can therefore be coded with a smaller codebook without loss of sound quality, permitting quantization distortion to be reduced to an acceptable level without the need to devote an extra ROM or other memory device to the codebook.

The disadvantage of conventional differential vector quantization is the matrix operation given in equation (1). If this operation is carried out by hardware with the configuration shown in FIG. 7, many multipliers are required, and many interconnections are required between the multipliers and the registers. These multipliers and their interconnections take up space and add significantly to the total cost of the device.

Figure 4:
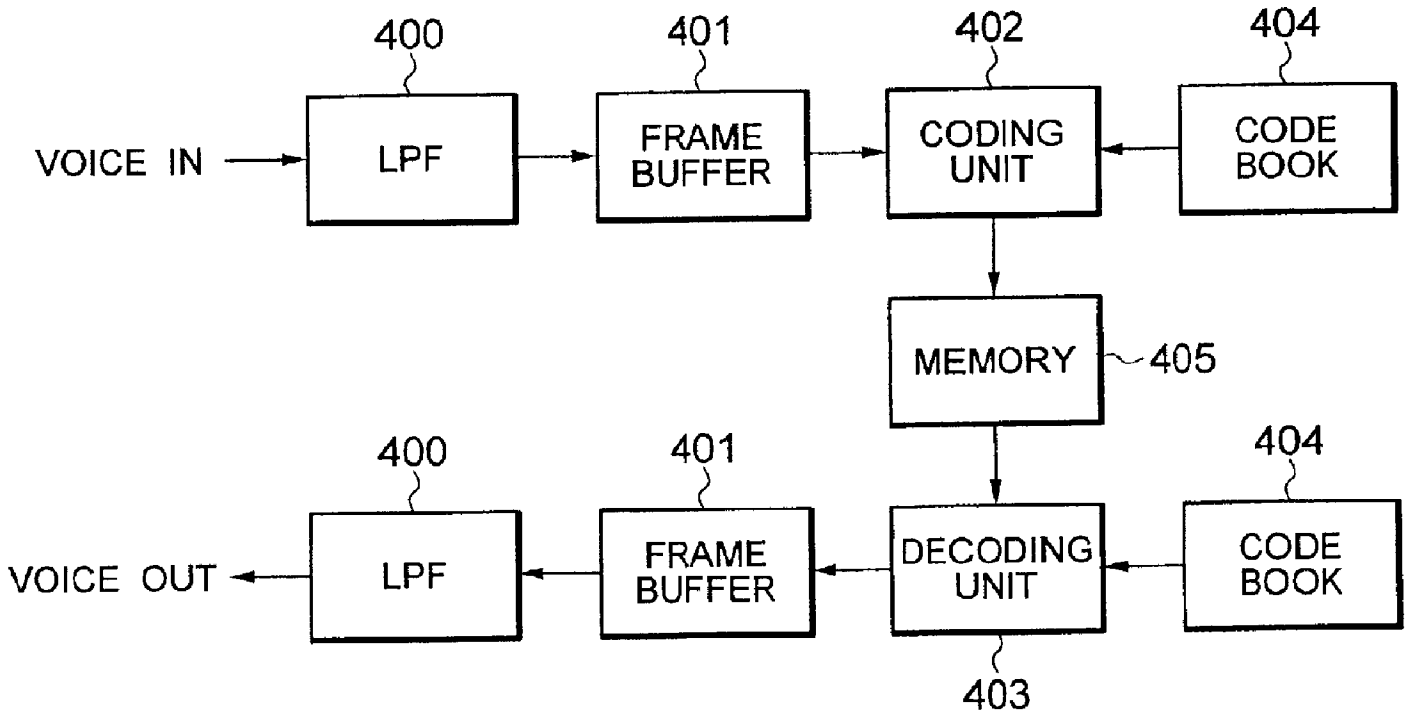
FIG. 4 PRIOR ART
FIG. 4 is a block diagram of a voice recorder employing differential vector quantization.

The invented voice data recorder has the overall structure shown in FIGS. 4, 5, and 6, but differs in the internal structure of the prediction unit.

Figure 8:
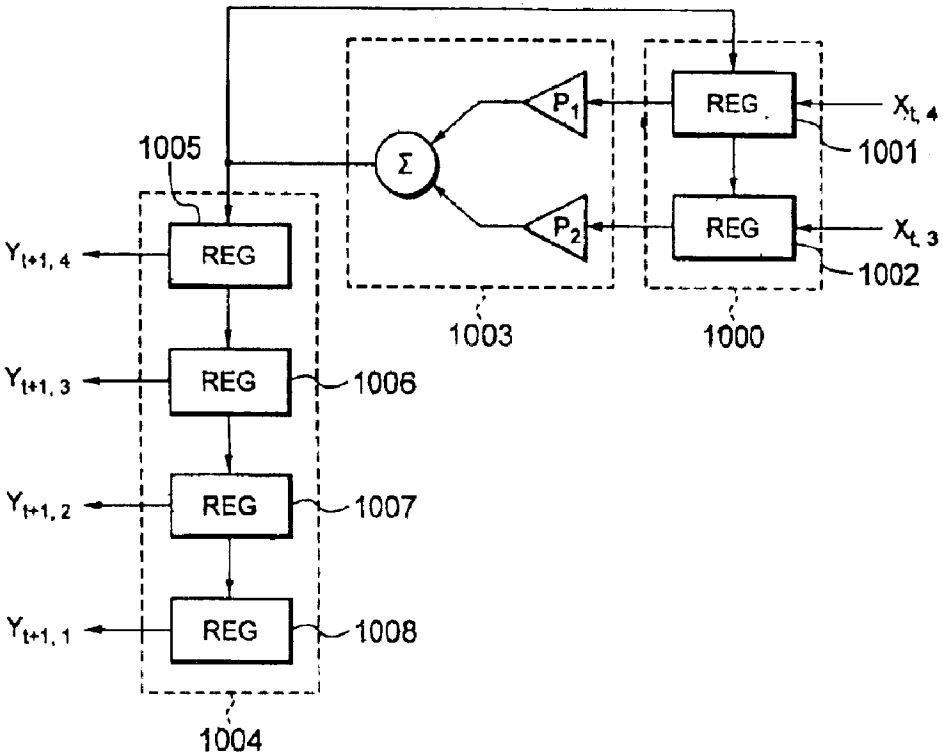
FIG. 8 is a schematic diagram of a novel prediction unit that can be used in FIGS. 5 and 6.

Referring to FIG. 8, in a first embodiment of the invention, the prediction unit comprises an input shift register 1000 with two register (REG) cells 1001, 1002, each storing one sample value. The stored values are supplied to an arithmetic unit 1003 that multiplies them by respective coefficients $P_1$, $P_2$, and adds the resulting pair of products. The resulting sum is supplied to an output shift register 1004 with four register cells 1005, 1006, 1007, 1008.

The prediction unit in FIG. 8 predicts each frame from two of the sample values of the immediately preceding frame, more specifically, from the sample values in the last half of the preceding frame. In the coding unit 402 and decoding unit 403, this prediction unit operates as follows.

First, the last two samples of the t-th decoded frame waveform are stored in the input shift register. $X_{t,4}$ is stored in register cell 1001, and $X_{t,3}$ in register cell 1002.

The arithmetic unit 1003 calculates the first predicted sample value $Y_{t+1,1}$ of the (t+1)-th frame from $X_{t,3}$ and $X_{t,4}$. The calculated value is output to but not yet stored in the shift registers 1000, 1004.

A timing signal (not visible) is now supplied to the shift registers, causing $X_{t,4}$ to be shifted from register cell 1001 into register cell 1002 and $Y_{t+1,1}$ to be shifted from the arithmetic unit 1003 into register cells 1001 and 1005.

The arithmetic unit 1003 then calculates the second predicted sample value $Y_{t+1,2}$ of the (t+1)-th frame from $X_{t,4}$ and $Y_{t+1,1}$. At the next timing signal, $Y_{t+1,1}$ is shifted into register cells 1002 and 1006, while $Y_{t+1,2}$ is shifted into register cells 1001 and 1005.

Proceeding in this fashion, the remaining two predicted sample values $Y_{t+1,3}$ and $Y_{t+1,4}$ of the (t+1)-th frame are calculated and shifted into the shift registers. At the end of these operations, $Y_{t+1,4}$ is stored in register cell 1005, $Y_{t+1,3}$ in register cell 1006, $Y_{t+1,2}$ in register cell 1007, and $Y_{t+1,1}$ in register cell 1008. The predicted values are output from these register cells to other elements in the coding unit 402 or decoding unit 403.

The predicted values are given by the following equations, in which an asterisk indicates multiplication.

$$Y_{t+1,1}=P_1*X_{t,4}+P_2*X_{t,3}$$

$$Y_{t+1,2}=P_1*Y_{t+1,1}+P_2*X_{t,4}$$

$$Y_{t+1,3}=P_1*Y_{t+1,2}+P_2*Y_{t+1,1}$$

$$Y_{t+1,4}=P_1*Y_{t+1,3}+P_2*Y_{t+1,2}$$

Appropriate values of the coefficients $P_1$ and $P_2$ can be determined by, for example, the well-known normalized least squares algorithm. In testing the first embodiment, the inventors used this algorithm to obtain the following values.

$P_1=1.26$ $P_2=-0.37$

Figure 9A:
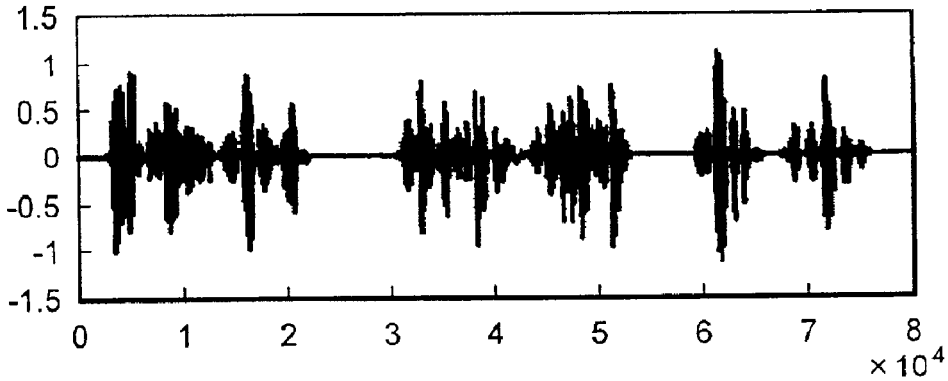
FIG. 9A PRIOR ART
FIG. 9A shows a voice waveform coded and decoded with the prediction unit in FIG. 7.
Figure 9B:
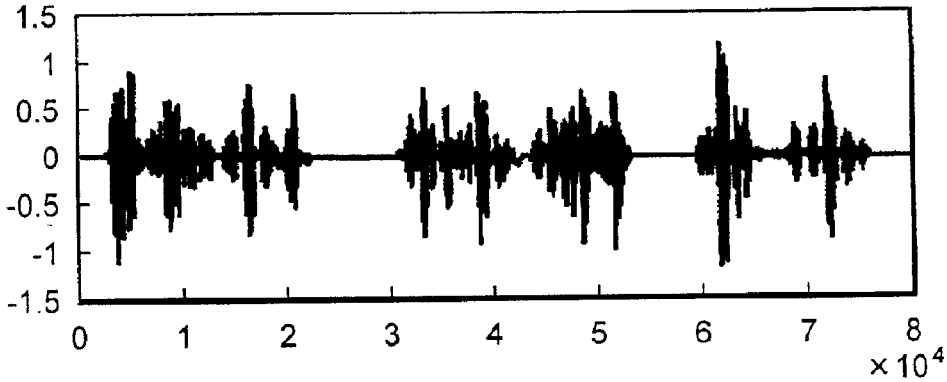
FIG. 9B shows the same voice waveform coded and decoded with the prediction unit in FIG. 8.

FIGS. 9A and 9B show an example of the test results. FIG. 9A shows the waveform of a voice signal recorded and reproduced using the voice recorder in FIG. 4 with the conventional prediction unit 505 in FIG. 7. FIG. 9B shows the waveform of the same voice signal recorded and reproduced using the prediction unit in FIG. 8. In both FIGS. 9A and 9B, the horizontal axis indicates consecutive sample numbers in units of ten thousand, and the vertical axis indicates signal values in arbitrary units. The waveforms in FIGS. 9A and 9B appear nearly identical, and calculations of the signal-to-noise (S/N) ratio showed no difference between them.

The first embodiment accordingly simplifies the structure of the prediction unit and lowers its cost with substantially no corresponding detriment to sound quality.

The circuit configuration in FIG. 8 can be modified by combining the input shift register 1001 and output shift register 1004 into a single shift register used for both input and output. In this input/output shift register, register cells 1001 and 1005 are combined into a single register cell, and register cells 1002 and 1006 are combined into a single register cell.

The first embodiment can be modified in various other ways. For example, the coefficient values can be modified. The frame length and hence the length of the shift registers can be modified. The samples used to predict each frame need not be the samples in the last half of the preceding frame, but can be some other subset of samples in the preceding frame.

Figure 10:
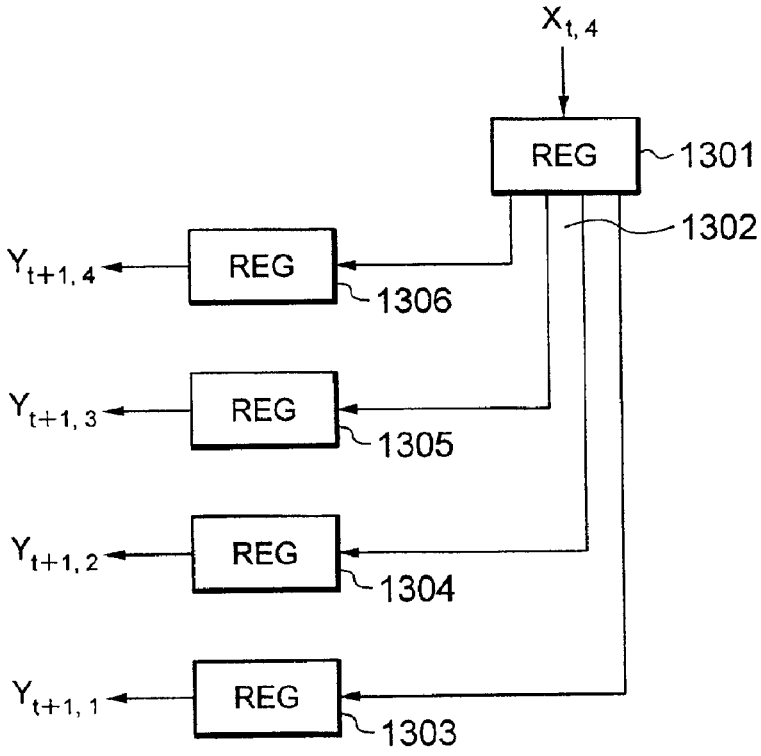
FIG. 10 is a schematic diagram of another novel prediction unit that can be used in FIGS. 5 and 6.

In a second embodiment of the invention, each frame is predicted from the last sample value of the immediately preceding frame. This corresponds to the first embodiment with coefficient $P_2$ set to zero and coefficient $P_1$ set to unity, so that all predicted values of the (t+1)-th frame are equal to $X_{t,4}$. Shift registers are no longer needed, the arithmetic unit can be eliminated, and the prediction unit has the simple structure shown in FIG. 10. The last sample value ($X_{t,4}$) in the t-th decoded frame is received by an input register 1301. The contents of the input register 1301 are copied through signal lines 1302 to four output registers 1303, 1304, 1305, 1306 and output as the predicted values $Y_{t+1,1}$, $Y_{t+1,2}$, $Y_{t+1,3}$, $Y_{t+1,4}$.

Since $P_1$ is unity and $P_2$ is zero, the predicted values are given by the following equations.

$$Y_{t+1,1}=P_1*X_{t,4}=X_{t,4}$$

$$Y_{t+1,2}=P_1*Y_{t+1,1}=X_{t,4}$$

$$Y_{t+1,3}=P_1*Y_{t+1,2}=X_{t,4}$$

$$Y_{t+1,4}=P_1*Y_{t+1,3}=X_{t,4}$$

Figure 11:
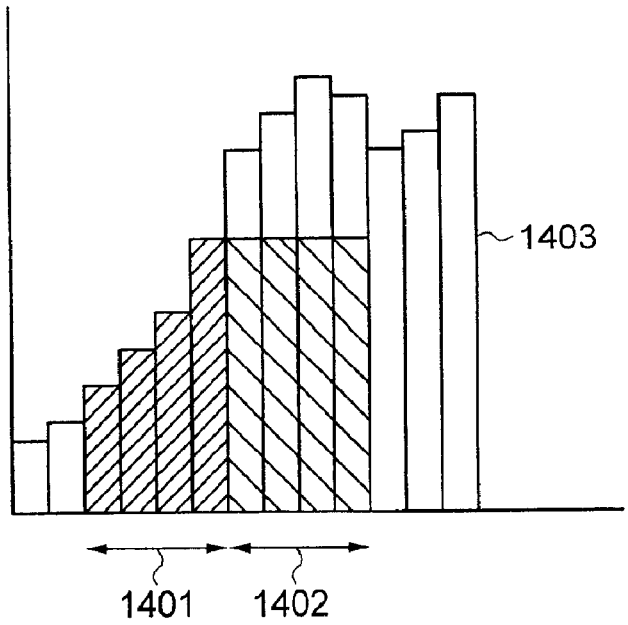
FIG. 11 is a waveform graph illustrating the operation of the prediction unit in FIG. 10.

The operation of the prediction unit in the second embodiment is illustrated in FIG. 11. The horizontal axis represents time; the vertical axis represents sample values. The input sample values 1401 are indicated by dark hatching and the output sample values 1402 by light hatching, the actual sample values 1403 being shown in white. The predicted output remains constant at the last input sample value.

The second embodiment normally produces a little more quantization distortion than the first embodiment. For example, the prediction shown in FIG. 11 is not as close as the prediction that could be obtained in the first embodiment. The configuration of the prediction unit in the second embodiment is extremely simple, however, making the second embodiment useful in applications in which minimum cost is of paramount importance.

Like the first embodiment, the second embodiment can be modified in regard to the length of a frame.

The invention may be practiced in either hardware or software.

Those skilled in the art will recognize that further variations are possible within the scope claimed below.

What is claimed is:

1. A method of using a codebook of frame patterns identified by index numbers to code a voice signal by sampling the voice signal to obtain sample values, grouping the sample values into frames, predicting the sample values in each frame, taking differences between the sample values and the predicted sample values in each frame to obtain a differential frame, searching the codebook to find a frame pattern most closely matching the differential frame, and writing the index number of the most closely matching frame pattern in a memory device as a coded value of the frame, each frame including a predetermined number of consecutive sample values from a first sample value to a last sample value, each sample value except the last sample value having a next sample value in the frame, wherein predicting the sample values in each frame comprises the steps of:

(a) predicting the first sample value in the frame from at least one sample value of an immediately preceding frame; and (b) using each predicted sample value in the frame, except the last sample value in the frame, in predicting the next sample value in the frame;

wherein said step (a) predicts that the first sample value in the frame is equal to the last sample value of the immediately preceding frame, and said step (b) predicts that all sample values in the frame after the first sample value in the frame are equal to the first sample value in the frame.

2. The method of claim 1, wherein predicting the sample values in each frame further comprises the steps of:

(c) loading a certain number of final sample values of the immediately preceding frame into a shift register; and (d) shifting each predicted sample value into the shift register.

3. The method of claim 2, wherein said steps (a) and (b) include performing a multiply-add operation on the sample values stored in the shift register.

4. The method of claim 2, wherein said certain number of final sample values constitute a last half of the sample values of the immediately preceding frame.

5. The method of claim 1, further comprising the step of:

(e) decoding each frame with reference to the codebook;

wherein said sample values of the immediately preceding frame are decoded sample values.

6. A voice recording and reproducing device of the type that samples a voice signal, divides the sampled voice signal into frames, predicts sample values of each frame, takes differences between the predicted sample values and actual sample values of the frame, codes the differences by vector quantization with reference to a codebook, stores resulting coded data in a memory device, and decodes the coded data with reference to the codebook, having a prediction unit comprising:

a first shift register for storing sample values; and an arithmetic unit coupled to the first shift register, performing an add-multiply operation on the sample values stored in the first shift register to obtain a predicted sample value, and feeding the predicted sample value back into the first shift register for use in predicting a next sample value;

wherein the voice recording and reproducing device predicts each said frame by predicting a first sample value, wherein the first sample value in the frame is equal to a last sample value of an immediately preceding frame, and using each predicted sample value in the frame in predicting the next sample value in the frame, wherein all sample values in the frame after the first sample value in the frame are equal to the first sample value in the frame.

7. The voice recording and reproducing device of claim 6, wherein the prediction unit further comprises a second shift register receiving and shifting each predicted sample value output from the arithmetic unit, storing a number of predicted sample values equivalent to a length of one frame for output as a predicted frame.

8. The voice recording and reproducing device of claim 6, wherein the sample values of the immediately preceding frame loaded into the first shift register constitute a last half of the sampled values of the immediately preceding frame.

9. The voice recording and reproducing device of claim 6, wherein said sample values of the immediately preceding frame are decoded sample values.

10. A voice recording and reproducing device of the type that samples a voice signal, divides the sampled voice signal into frames, predicts sample values of each frame, take differences between the predicted sample values and actual sample values of the frame, codes the differences by vector quantization with reference to a codebook, stores resulting coded data in a memory device, and decodes the coded data with reference to the codebook, wherein predicting a first sample value, the first sample value in the frame equal to a last sample value of an immediately preceding frame, and using each predicted sample value in the frame in predicting the next sample value in the frame, wherein all sample values in the frame after the first sample value in the frame are equal to the first sample value in the frame.

11. The voice recording and reproducing device of claim 10, having a prediction unit comprising:

an input register storing said last sample value of the immediately preceding frame;

a plurality of output registers storing said predicted sample values; and signal lines for copying said last sample value from the input register to each one of the output registers.

12. The voice recording and reproducing device of claim 10, wherein said last sample value of the immediately preceding frame is a decoded sample value.

* * * * *